US009903639B2

(12) United States Patent
Eom et al.

(10) Patent No.: US 9,903,639 B2
(45) Date of Patent: Feb. 27, 2018

(54) REFRIGERATOR

(71) Applicant: Samsung Electronics Co., Ltd., Suwon-si (KR)

(72) Inventors: Tae-In Eom, Hwaseong-si (KR); Nam Soo Park, Suwon-si (KR); Jea Won Lee, Hwaseong-si (KR)

(73) Assignee: SAMSUNG ELECTRONICS CO., LTD. (KR)

( * ) Notice: Subject to any disclaimer, the term of this patent is extended or adjusted under 35 U.S.C. 154(b) by 0 days.

(21) Appl. No.: 15/049,686

(22) Filed: Feb. 22, 2016

(65) Prior Publication Data

US 2016/0245579 A1 Aug. 25, 2016

(30) Foreign Application Priority Data

Feb. 23, 2015 (KR) ..... 10-2015-0025057

(51) Int. Cl.

| | |
|---|---|
| ***F25D 23/02*** | (2006.01) |
| ***E05D 7/00*** | (2006.01) |
| ***E05D 15/00*** | (2006.01) |
| ***E05F 3/20*** | (2006.01) |
| ***E05F 5/02*** | (2006.01) |
| ***F25D 23/06*** | (2006.01) |

(52) U.S. Cl.

CPC ..... *F25D 23/028* (2013.01); *E05D 7/00* (2013.01); *E05D 15/00* (2013.01); *E05F 3/20* (2013.01); *E05F 5/02* (2013.01); *F25D 23/062* (2013.01); *F25D 2323/024* (2013.01)

(58) Field of Classification Search

CPC ..... F25D 23/028; F25D 23/062; E05D 7/00; E05D 15/00; E05F 3/20; E05F 5/02

USPC ..... 312/401, 405, 405.1, 319.1, 319.2, 326; 16/277

See application file for complete search history.

(56) References Cited

U.S. PATENT DOCUMENTS

| | | | |
|---|---|---|---|
| 5,573,323 | A | 11/1996 | Kim et al. |
| 5,896,619 | A | 4/1999 | Koopman |
| 5,931,554 | A | 8/1999 | Koopman |
| 6,338,536 | B1 | 1/2002 | Ueno et al. |

(Continued)

FOREIGN PATENT DOCUMENTS

| | | | |
|---|---|---|---|
| CN | 1699902 | A | 11/2005 |
| CN | 1945178 | A | 4/2007 |

(Continued)

OTHER PUBLICATIONS

European Search Report dated Jul. 20, 2016 corresponding to European Patent Application No. EP 16155799.6.

(Continued)

*Primary Examiner* — James O Hansen
(74) *Attorney, Agent, or Firm* — McAndrews, Held & Malloy, Ltd.

(57) ABSTRACT

Disclosed herein is a refrigerator including a body, a storage compartment formed in the body, a door which opens and closes the storage compartment, a damper that mitigates an impact, which occurs when the door is closed, and includes a cylinder, a piston that moves back and forth in the cylinder, and a pressurizing rod that transfers a pressure applied from the door to the piston, and a hinge that rotatably supports the door and includes a hinge bracket which connects the body to the door and a guide rail that guides a movement of the pressurizing rod.

15 Claims, 12 Drawing Sheets

(56) References Cited

U.S. PATENT DOCUMENTS

| | | | | |
|---|---|---|---|---|
| 8,444,237 | B2 * | 5/2013 | Kang | F25D 23/028 312/319.2 |
| 2004/0040118 | A1 | 3/2004 | Han et al. | |
| 2005/0212392 | A1 * | 9/2005 | Jung | E05D 11/1064 312/405 |
| 2005/0258724 | A1 * | 11/2005 | Hwa Kim | E05F 3/10 312/405 |
| 2005/0262868 | A1 | 12/2005 | Jeong et al. | |
| 2011/0068671 | A1 * | 3/2011 | Vanini | E05F 5/02 312/405 |
| 2013/0221825 | A1 | 8/2013 | Bonomie et al. | |

FOREIGN PATENT DOCUMENTS

| | | | |
|---|---|---|---|
| JP | H07190603 | A | 7/1995 |
| KR | 20070044652 | A | 4/2007 |
| KR | 20140016398 | A | 8/2015 |

OTHER PUBLICATIONS

Communication under Rule 71(3) EPC dated Mar. 31, 2017 corresponding to European Patent Application No. EP 16155799.6.
Office Action dated Nov. 6, 2017 corresponding to Chinese Patent Application No. CN 201610097168.8.

* cited by examiner

REFRIGERATOR

RELATED APPLICATION(S)

This application claims the benefit of Korean Patent Application No. 10-2015-0025057, filed on Feb. 23, 2015 in the Korean Intellectual Property Office, the disclosure of which is incorporated herein by reference.

BACKGROUND

Embodiments of the present disclosure relate to a refrigerator with a damper for mitigating an impact that occurs when a door is closed.

Generally, refrigerators are appliances that include storage compartments for storing food and cool air supply devices to keep food fresh. The storage compartment may be provided in a body while a front thereof is to be open. The open front may be closed by a door.

The door may be rotatably coupled to the body using a hinge. The door may include an insulator for insulating the storage compartment. A door guard for storing food may be provided on a rear side of the door. Accordingly, since the door has a considerable weight due to the insulator and the food stored in the door guard, the door may collide with the body when the door is closed, thereby allowing an impact to occur.

SUMMARY

Therefore, it is an aspect of the present disclosure to provide a refrigerator capable of mitigating an impact that occurs when a door is closed.

It is another aspect of the present disclosure to provide a refrigerator having a damper capable of mitigating an impact that occurs when a door is closed.

It is still another aspect of the present disclosure to provide a refrigerator having a structure to guide a pressurizing rod of a damper that mitigates an impact that occurs when a door is closed to smoothly move.

It is yet another aspect of the present disclosure to provide a hinge having a structure to guide a pressurizing rod of a damper that mitigates an impact that occurs when a door is closed to smoothly move.

Additional aspects of the disclosure will be set forth in part in the description which follows and, in part, will be obvious from the description, or may be learned by practice of the disclosure.

In accordance with one aspect of the present disclosure, a refrigerator includes a body, a storage compartment formed in the body, a door that opens or closes the storage compartment, a damper that mitigates an impact, that occurs when the door is closed, and includes a cylinder, a piston that moves back and forth in the cylinder, and a pressurizing rod that transfers a pressure applied from the door to the piston, and a hinge that rotatably supports the door and includes a hinge bracket that connects the body to the door and a guide rail that guides a movement of the pressurizing rod.

The hinge bracket and the guide rail may be separately provided and mutually coupled.

The guide rail may include a rail body coupled to the hinge bracket and a guide portion that guides the movement of the pressurizing rod.

The guide rail may include a pair of guide walls that are provided on both sides of the pressurizing rod and extend in a movement direction of the pressurizing rod to guide the movement of the pressurizing rod.

The guide rail may include a guide path formed between the pair of guide walls.

The guide rail may include separation prevention grooves formed on the pair of guide walls to prevent a separation of the pressurizing rod.

The pressurizing rod may include a head portion pressurized by the door and guided by the guide rail.

The head portion may include a separation prevention protrusion that protrudes to prevent a separation from the guide rail.

The door may include a pressurizing roller portion that protrudes to pressurize the pressurizing rod.

The pressurizing roller portion may include a base portion coupled to a top side of the door, a roller installation portion that extends from the base portion, and a roller rotatably installed in the roller installation portion.

In accordance with another aspect of the present disclosure, a refrigerator includes a body, a storage compartment formed in the body, a door that opens or closes the storage compartment, a hinge that rotatably supports the door, a hinge cover coupled to a top of the body to cover the hinge, and a damper that mitigates an impact, which occurs when the door is closed, and is coupled with the hinge cover.

The damper may include a damping device that performs a damping operation and a damper housing that accommodates the damping device and coupled with the hinge cover.

The damper housing may include a first coupling portion that protrudes to be coupled with the hinge cover.

The hinge cover may include a second coupling portion coupled with the first coupling portion.

The hinge cover may include an upper wall, a sidewall portion that extends downward from an edge of the upper wall, and a hinge accommodating portion formed inside the upper wall and the sidewall portion. Here, the damper may be coupled to an inside surface of the upper wall.

The hinge cover may include an opening through that the damper passes.

In accordance with still another aspect of the present disclosure, a refrigerator includes a body, a storage compartment formed in the body, a door that opens or closes the storage compartment, a hinge that rotatably supports the door, a damper that mitigates an impact which occurs when the door is closed, and a hinge cover coupled with a top of the door to form a hinge accommodating portion that accommodates the hinge and the damper.

The damper may include a moving part that moves according to an opening and closing operation of the door and a part fixed to the hinge cover regardless of the opening and closing operation of the door. Here, the hinge may include a guide rail that guides the movement of the moving part.

The hinge cover may include an upper wall and a sidewall portion that extends downward from an edge of the upper wall. Here, the damper may be coupled to the upper wall.

In accordance with yet another aspect of the present disclosure, a hinge includes a hinge bracket coupled with a body including a storage compartment, a pivot shaft inserted into a door that opens and closes the storage compartment and configured to rotatably support the door, and a guide rail coupled to the hinge bracket to guide a movement of a damper that mitigates an impact which occurs when the door is closed.

The hinge may include a rail body coupled with the hinge bracket and a pair of guide walls that protrude from the rail body and extend from both sides of the damper in a movement direction of the damper.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, exemplary embodiments of the present disclosure will be described in detail.

Figure 1:
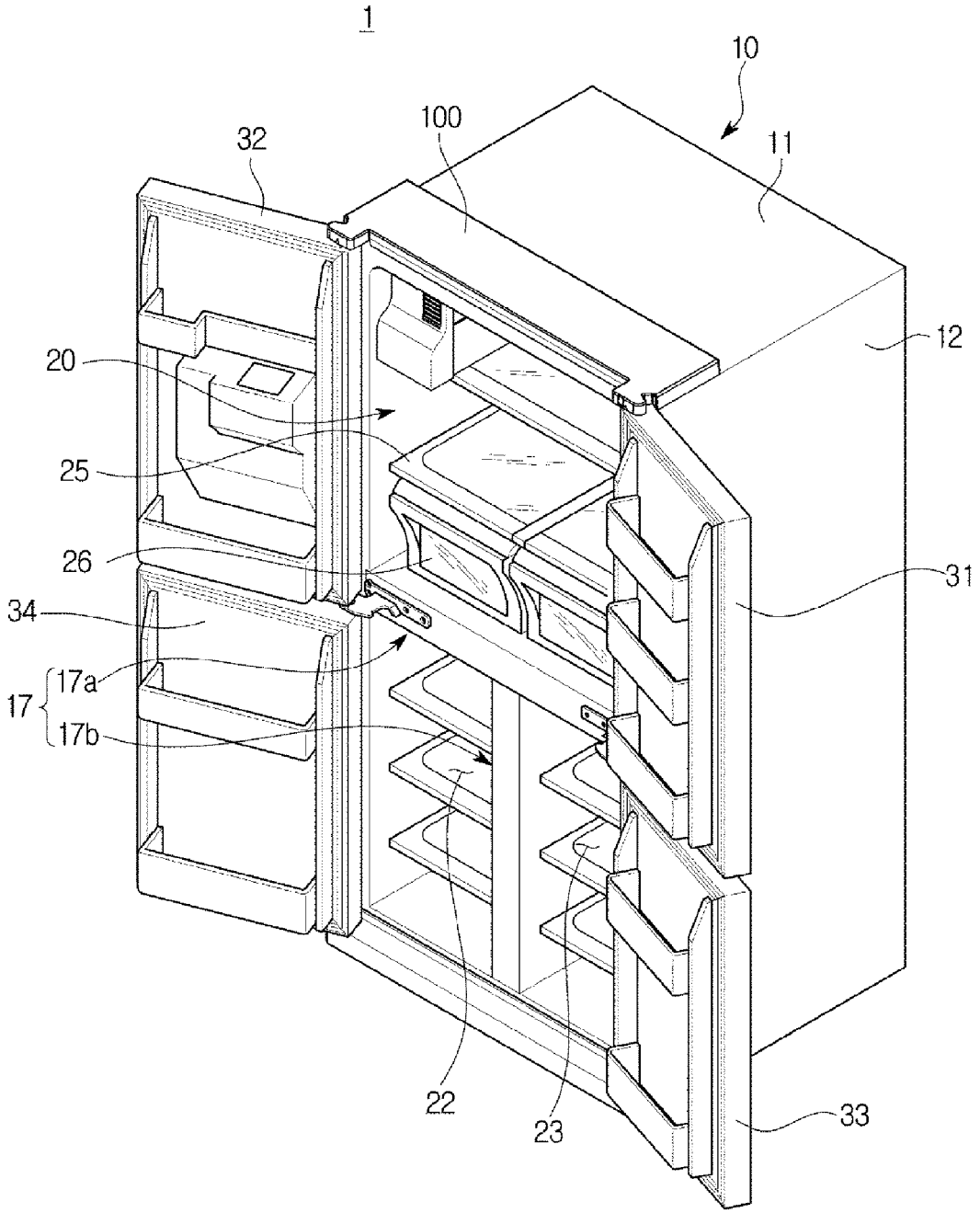
FIG. 1 is a perspective view illustrating an external shape of a refrigerator in accordance with one embodiment of the present disclosure.

FIG. 1 is a perspective view illustrating an external shape of a refrigerator 1 in accordance with one embodiment of the present disclosure. Referring to FIG. 1, the refrigerator 1 in accordance with an embodiment of the present disclosure will be described.

The refrigerator 1 includes a body 10, a storage compartment 20 formed in the body 10, and a cool air supply device (not shown) that supplies cool air to the storage compartment 20.

The body 10 is provided in an approximate box shape. That is, the body 10 includes an upper wall 11, a left sidewall, a right sidewall 12, a rear wall, and a bottom wall. In another aspect, the body 10 may include an inner casing, an outer casing, and an insulator provided between the inner casing and the outer casing to insulate the storage compartment 20.

The storage compartment 20 may be divided by a horizontal partition 17*a* and a vertical partition 17*b* into a plurality of smaller compartments. In the embodiment, for example, the storage compartment 20 is divided into an upper storage compartment 21, and a lower left storage compartment 22 and a lower right storage compartment 23.

The storage compartment 20 may include a shelf 25 to place food thereon and an airtight container 26 to store food airtight.

The storage compartment 20 may include an open front to allow food to be placed therein or withdrawn therefrom. The open front may be opened and closed by a plurality of doors. For example, the upper storage compartment 21 may be opened and closed by an upper right door 31 and an upper left door 32. Similarly, the lower left storage compartment 22 may be opened and closed by a lower left door 34, and the lower right storage compartment 23 may be opened and closed by a lower right door 33.

However, the concept of the present disclosure is not limited to the embodiment described above. It may be generally applied not only to a refrigerator with four doors described above but also to refrigerators with a rotatable door regardless of types thereof such as side by side (SBS) type refrigerators, top mounted freezer (TMF) type refrigerators, bottom mounted freezer (BMF) type refrigerators, French door refrigerators (FDR), refrigerators with one door, etc.

Hereinafter, among the upper right door 31, the upper left door 32, the lower right door 33, and the lower left door 34, the upper right door 31 located on a top in a right side will be described. However, a damping structure according to embodiments of the present disclosure may be appropriately modified and applied to the upper left door 32, the lower right door 33, and the lower left door 34.

A hinge cover 100 is coupled to the upper wall 11 of the body 10 to cover a hinge.

Figure 2:
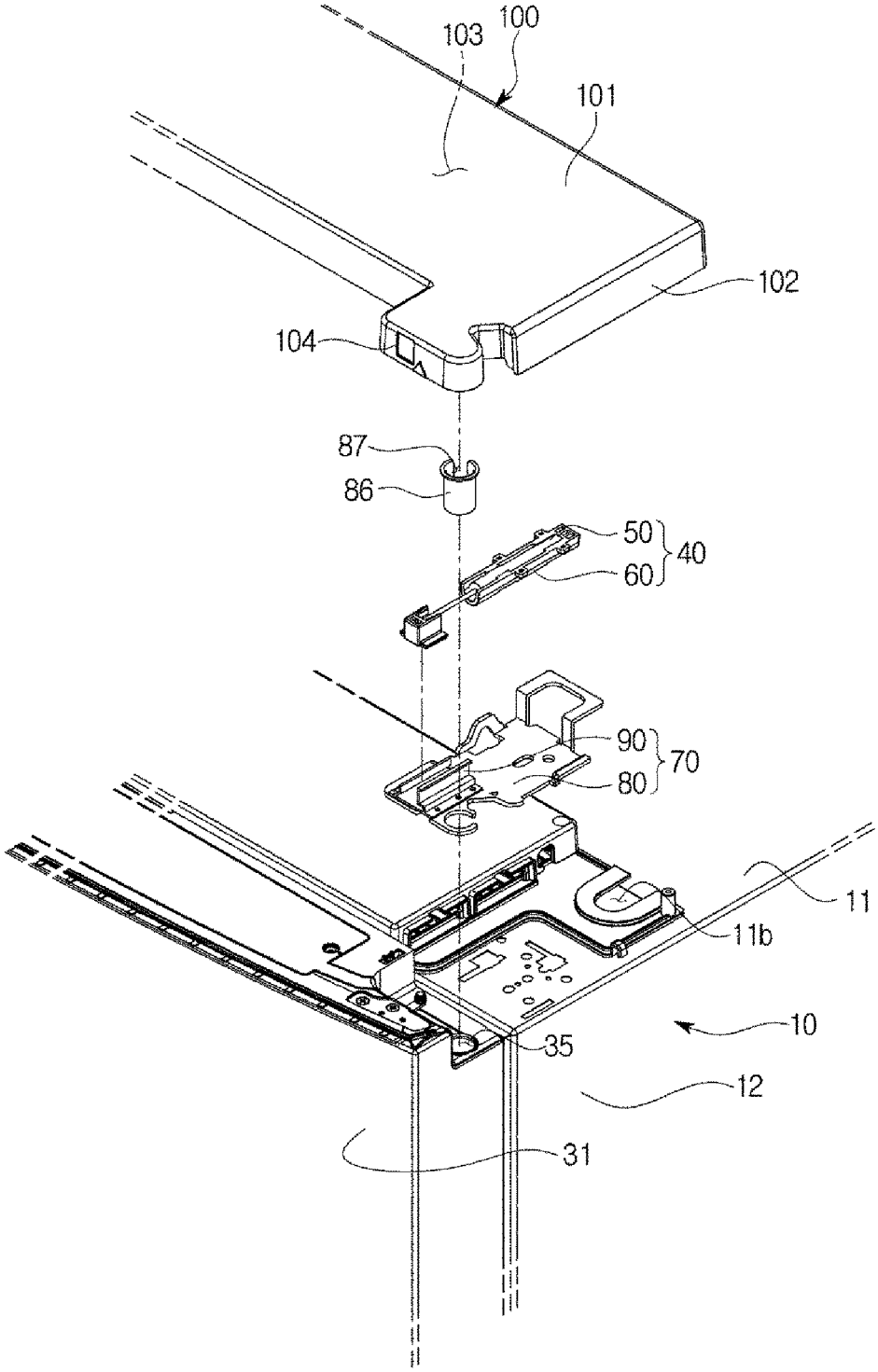
FIG. 2 is an exploded perspective view illustrating a principal part of the refrigerator in accordance with one embodiment of the present disclosure.
Figure 3:
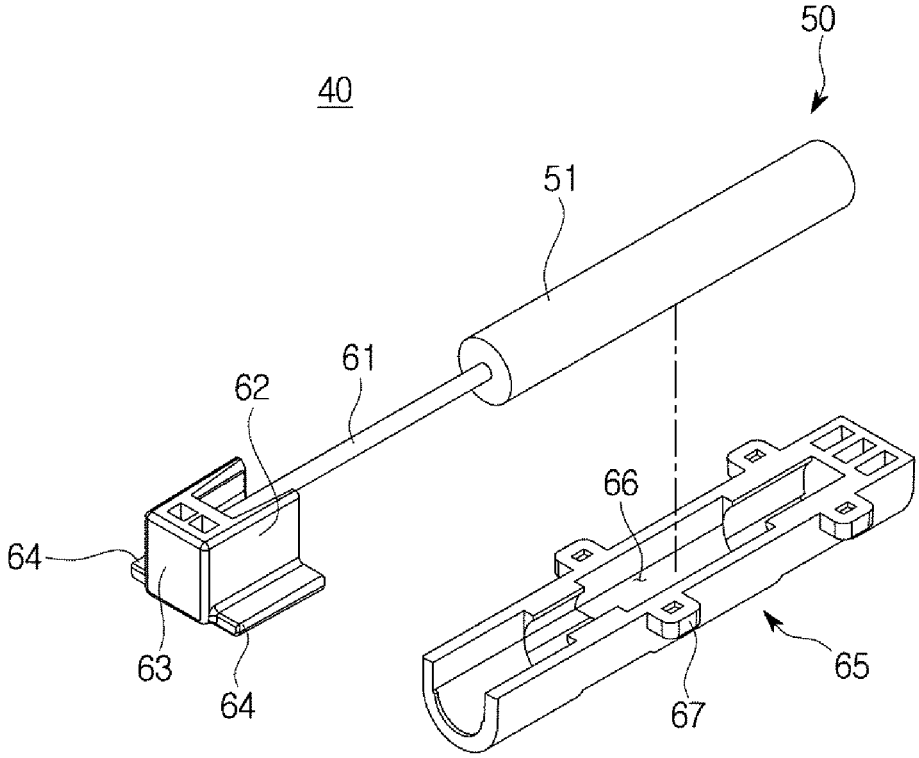
FIG. 3 is an exploded perspective view illustrating components of a damper in accordance with one embodiment of the present disclosure.
Figure 4:
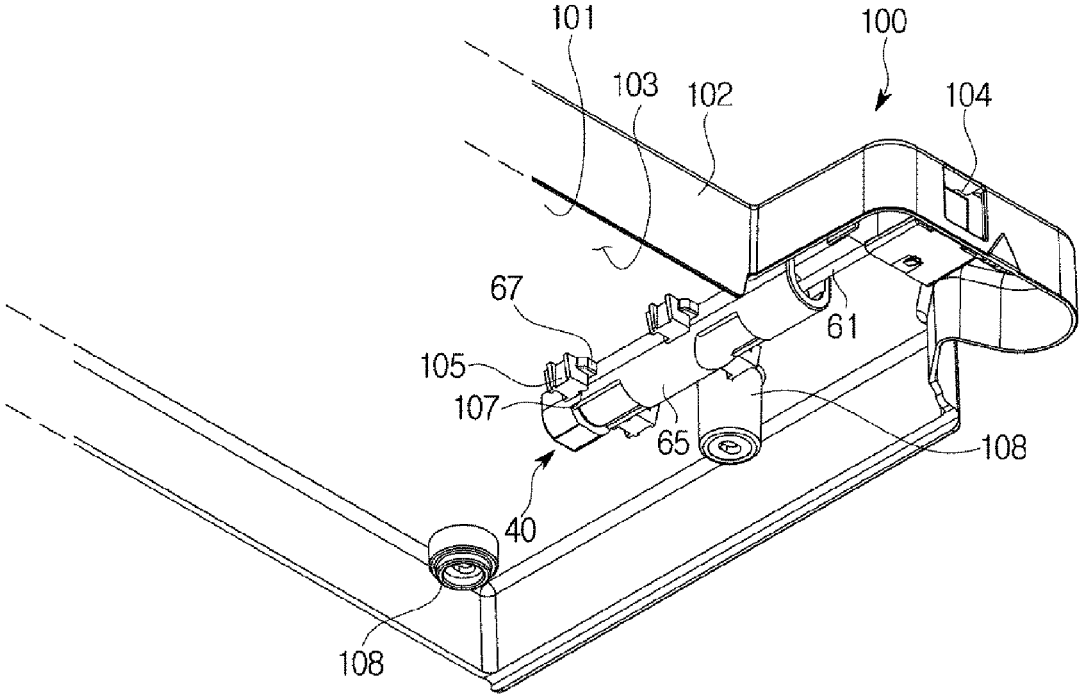
FIG. 4 is a bottom perspective view illustrating a state in which the damper is coupled to a hinge cover in accordance with one embodiment of the present disclosure.
Figure 5:
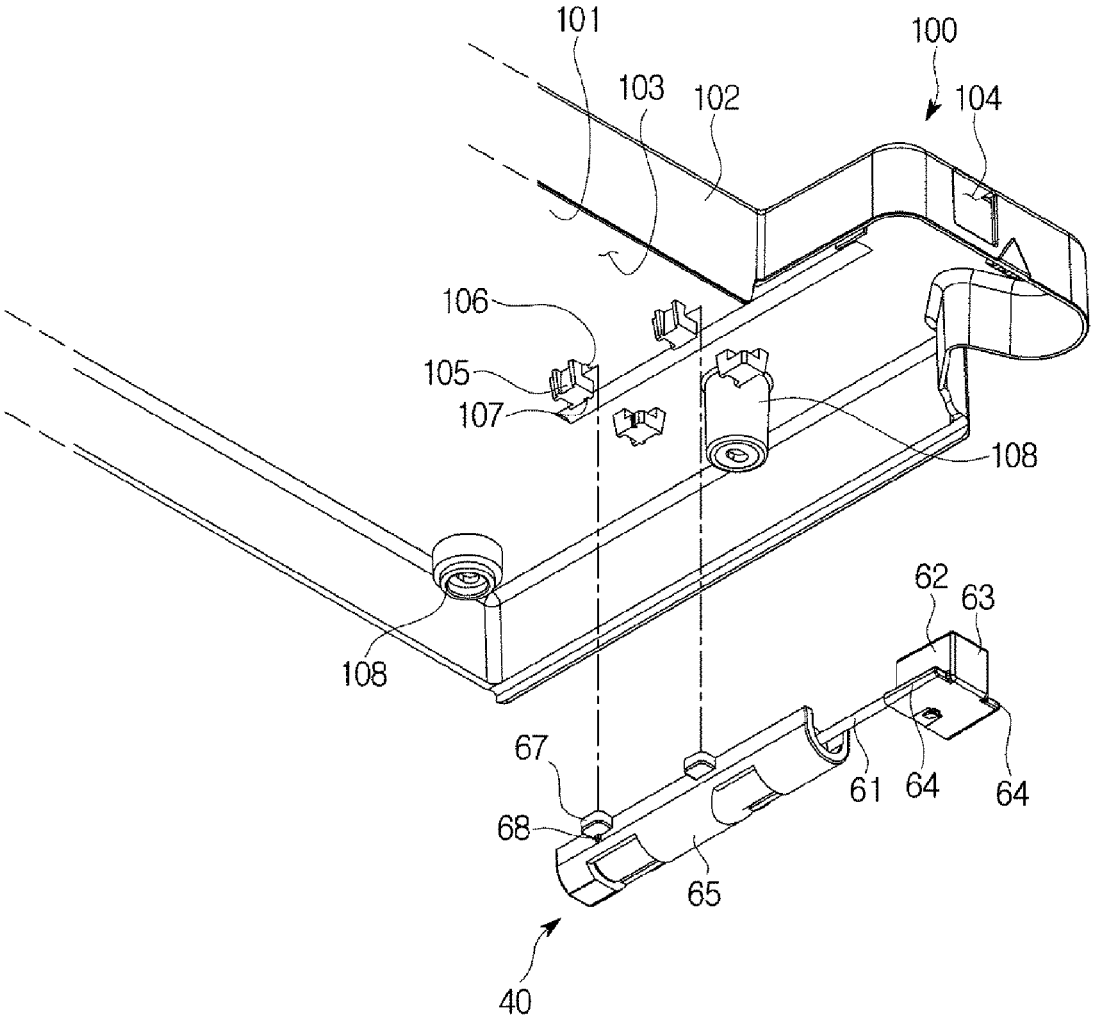
FIG. 5 is a bottom perspective view illustrating a state in which the damper is separated from the hinge cover in accordance with one embodiment of the present disclosure.
Figure 6:
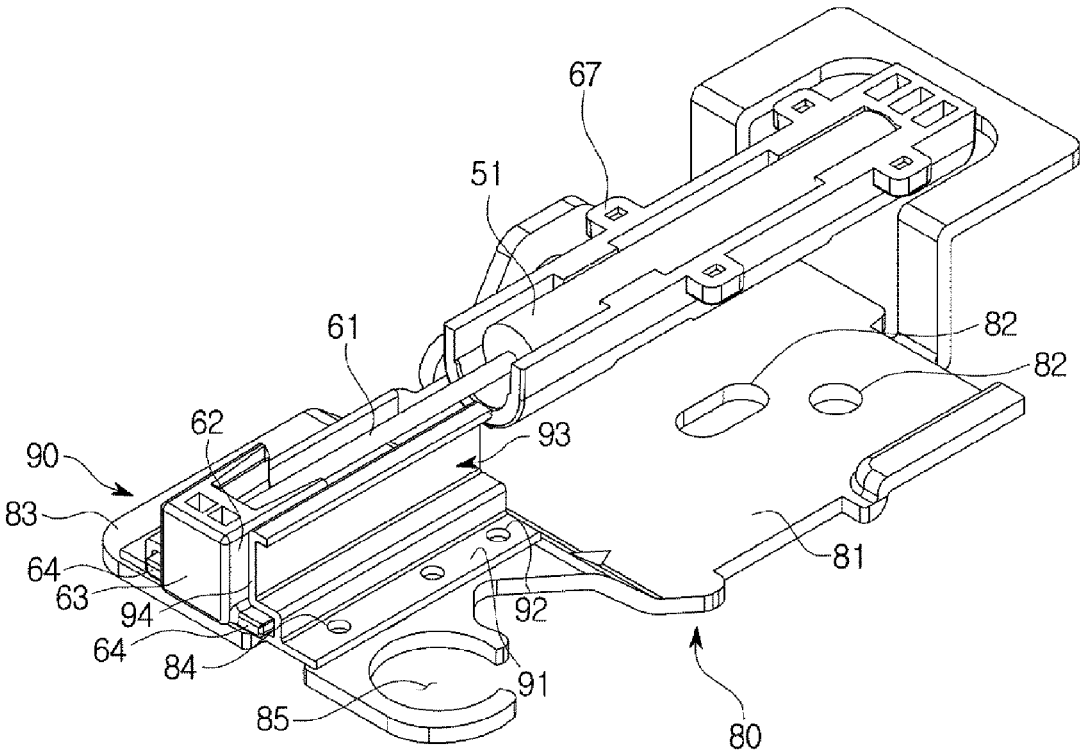
FIG. 6 is a perspective view illustrating the damper and a guide rail in accordance with one embodiment of the present disclosure.
Figure 7:
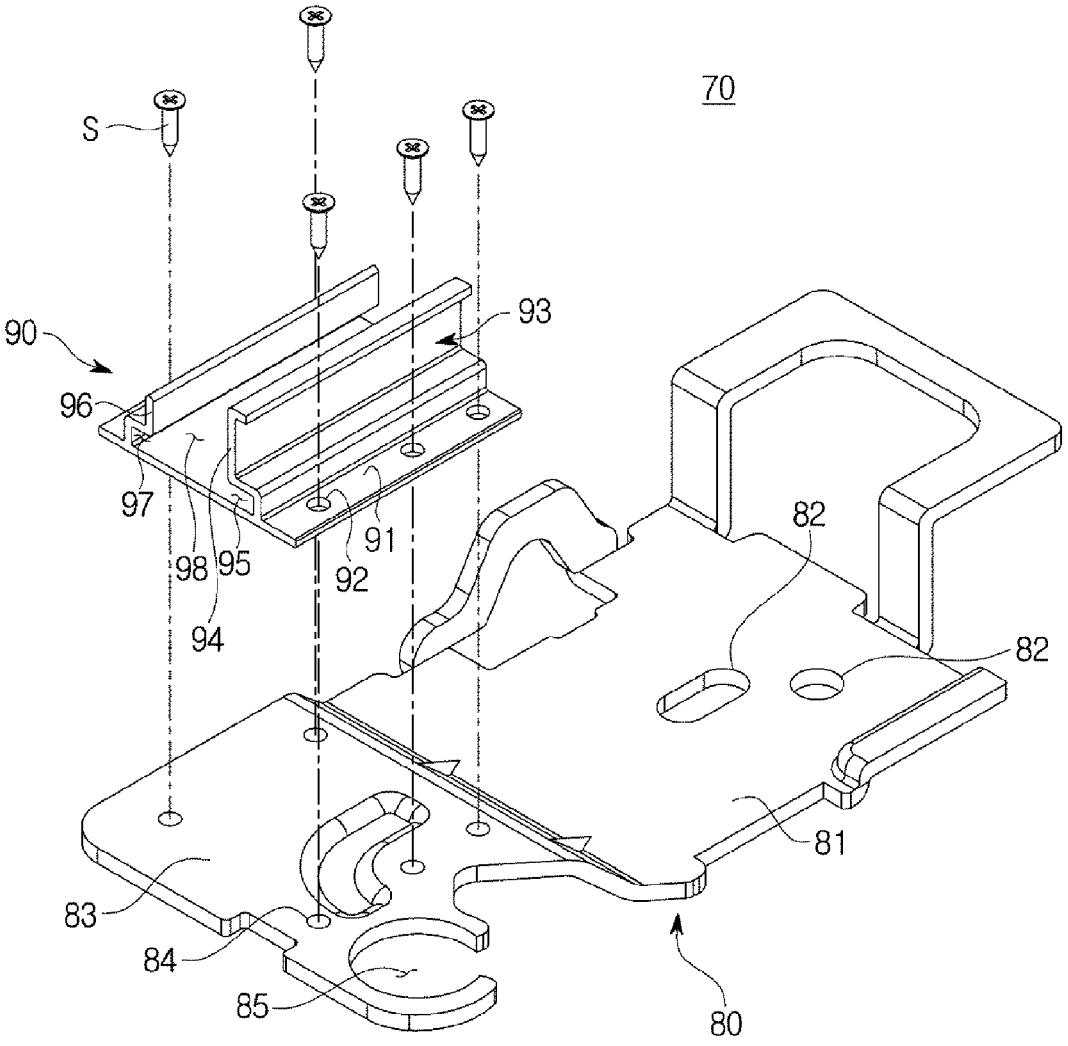
FIG. 7 is a perspective view illustrating components of a hinge, that is, a hinge bracket and the guide rail in accordance with one embodiment of the present disclosure.
Figure 8:
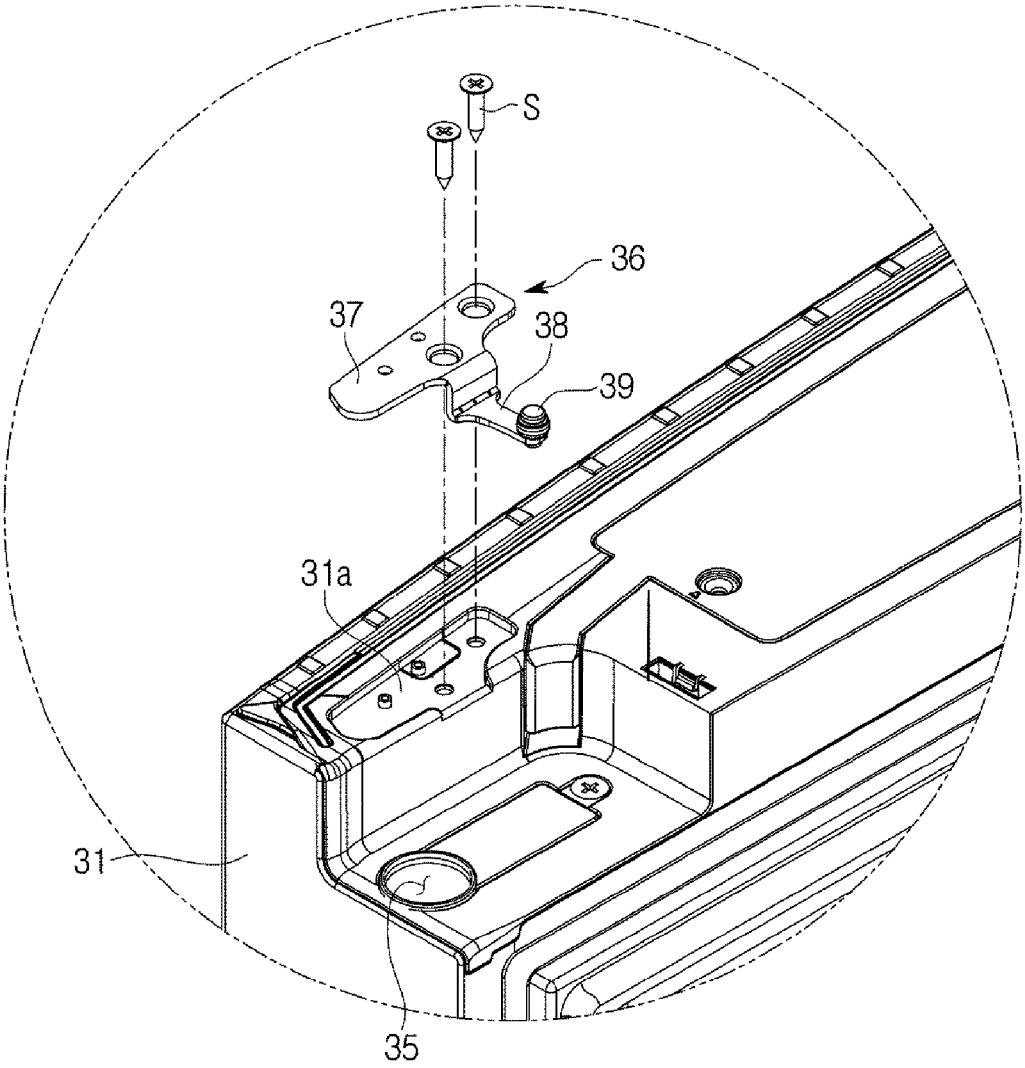
FIG. 8 is an exploded perspective view illustrating a door and a pressurizing roller portion in accordance with one embodiment of the present disclosure.
Figure 9:
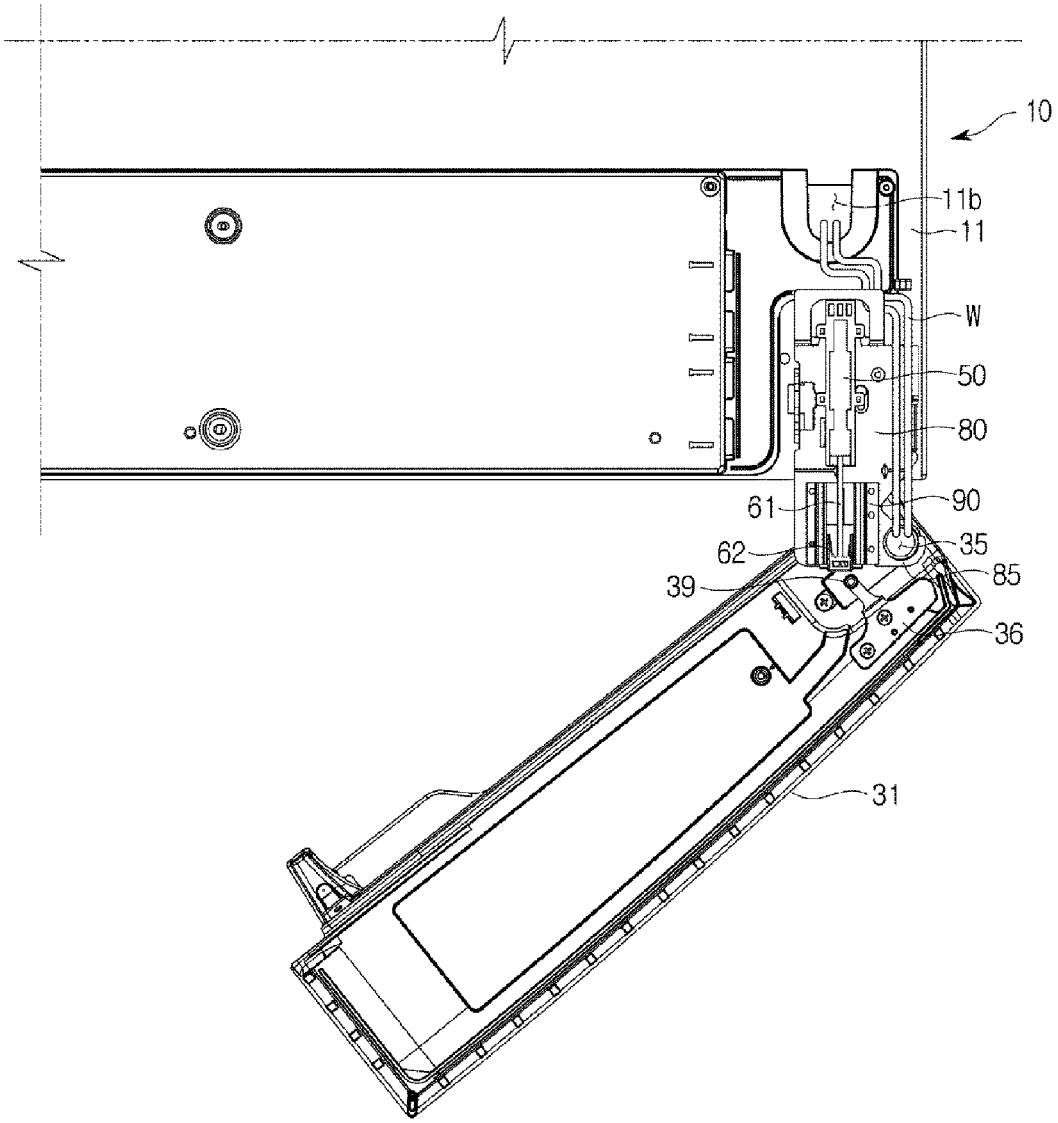
FIGS. 9 and 10 are views illustrating an operation of the damper in accordance with one embodiment of the present disclosure.
Figure 10:
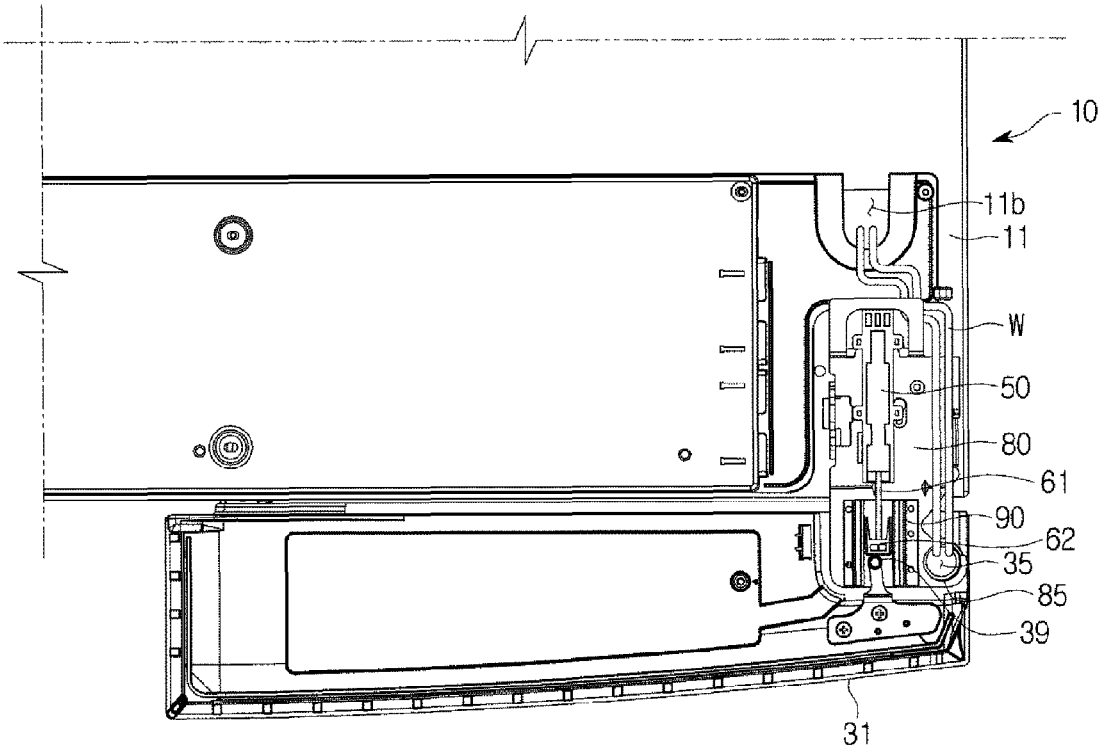
Figure 11:
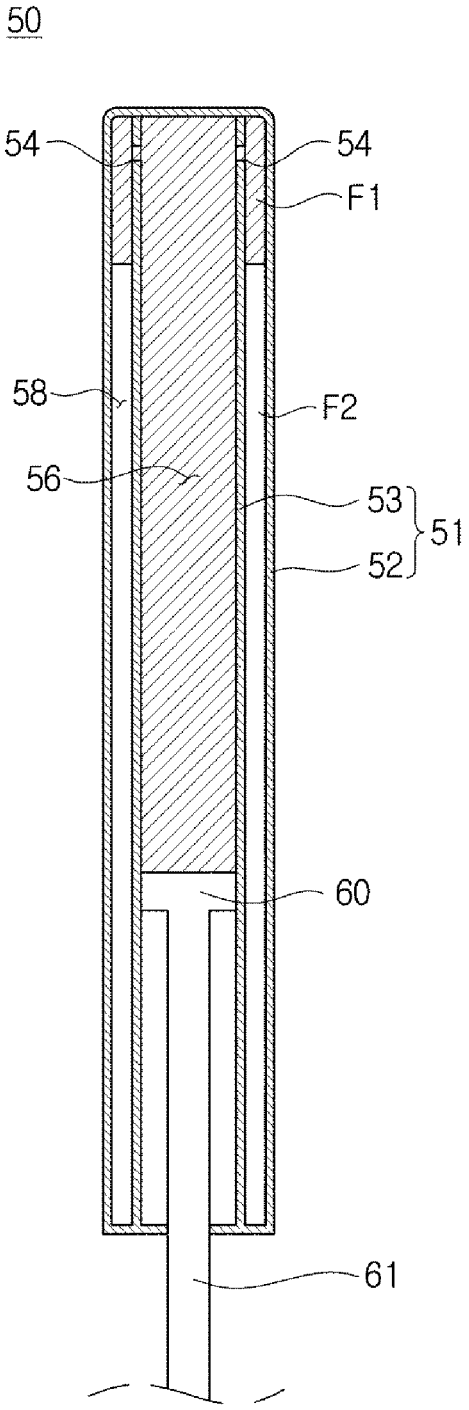
FIGS. 11 and 12 are views illustrating a structure of the damper in accordance with one embodiment of the present disclosure.
Figure 12:
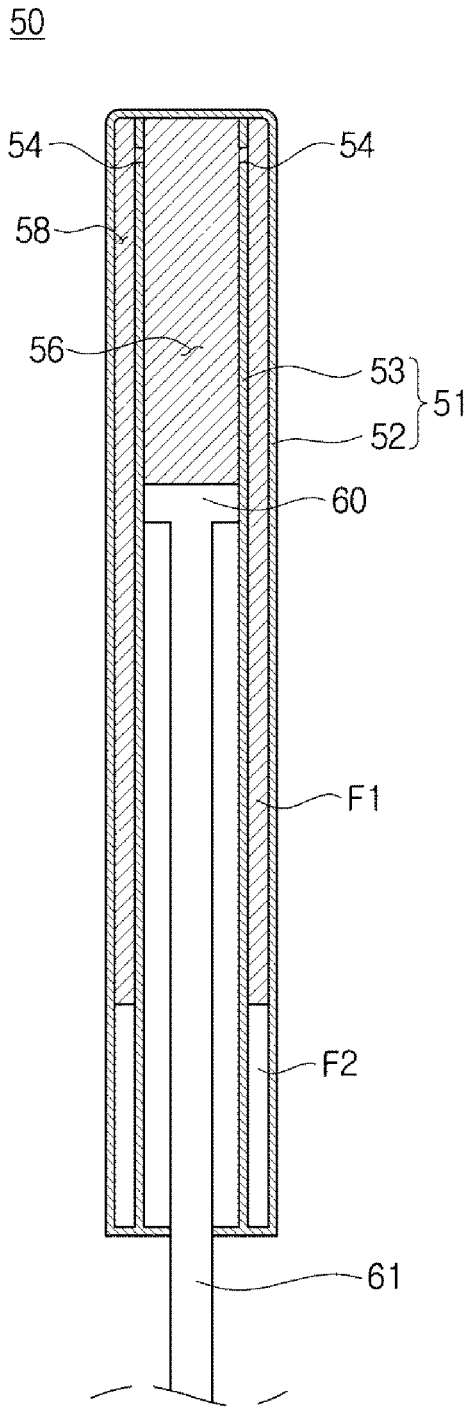

FIG. 2 is an exploded perspective view illustrating a principal part of the refrigerator 1 in accordance with one embodiment of the present disclosure. FIG. 3 is an exploded perspective view illustrating components of a damper 40 in accordance with one embodiment of the present disclosure. FIG. 4 is a bottom perspective view illustrating a state in which the damper 40 is coupled to the hinge cover 100 in accordance with one embodiment of the present disclosure. FIG. 5 is a bottom perspective view illustrating a state in which the damper 40 is separated from the hinge cover 100 in accordance with one embodiment of the present disclosure. FIG. 6 is a perspective view illustrating the damper 40 and a guide rail 90 in accordance with one embodiment of the present disclosure. FIG. 7 is a perspective view illustrating components of a hinge 70, that is, a hinge bracket 80 and the guide rail 90 in accordance with one embodiment of the present disclosure. FIG. 8 is an exploded perspective view illustrating the upper right door 31 and a pressurizing roller portion 36 in accordance with one embodiment of the present disclosure. FIGS. 9 and 10 are views illustrating an operation of the damper 40 in accordance with one embodiment of the present disclosure. FIGS. 11 and 12 are views illustrating a structure of the damper 40 in accordance with one embodiment of the present disclosure.

Referring to FIGS. 2 to 8, the refrigerator 1 includes the damper 40 for mitigating an impact caused by a collision with the body 10 when the upper right door 31 is closed and the hinge 70 that supports the upper right door 31 to be rotatable.

The term a damper includes various meanings such as a buffer, a buffering device, a damper, a shock absorber, etc.

The damper 40 in accordance with one embodiment of the present disclosure includes a damping device 50 that substantially performs a damping function and a damper housing 65 to protect the damping device 50 and to allow the damping device 50 to be coupled to the hinge cover 100.

Referring to FIGS. 3, 11, and 12, the damper 40 in accordance with one embodiment of the present disclosure will be described.

The damping device 50 in accordance with one embodiment of the present disclosure includes a cylinder 51, a piston 60 that moves back and forth inside the cylinder 51, a pressurizing rod 61 that is connected to the piston 60 and extends to the outside of the cylinder 51, and damping fluids F1 and F2 that are gradually compressed according to the movement of the piston 60 and provides a damping force to the piston 60. Here, the pressurizing rod 61 and the piston 60 may be referred to as moving parts and the cylinder 51 may be referred to as a cylinder part.

The cylinder 51 includes an inner container 52 having a first space 56 and an outer container 53 that forms a second space 58 between the inner container 52 and the outer container 53. The first space 56 and the second space 58 may be interconnected by a through hole 54 formed in the inner container 52.

The first space 56 may be filled with the damping fluid F1, and the second space 58 may be filled with the damping fluids F1 and F2. Here, the damping fluid F1 may be oil and the damping fluid F2 may be gas.

When an external force is applied inwards to the pressurizing rod 61, the pressurizing rod 61 pressurizes the piston 60 while moving inwards, and the piston 60 pressurizes the damping fluids F1 and F2. The damping fluid F1 of the first space 56 pressurizes the damping fluid F2 while moving toward the second space 58 through the through hole 54. The damping fluid F2 may provide the damping force while being gradually compressed.

When the external force applied to the pressurizing rod 61 is removed, the damping fluid F2 expands to an original state and pushes the damping fluid F1 from the second space 58 to the first space 56. The damping fluid F1 moves from the second space 58 to the first space 56 through the through hole 54 and externally pressurizes the piston 60. Accordingly, the piston 60 may be restored to an original state.

Here, the external force applied to the pressurizing rod 61 acts from the upper right door 31. The force that acts on the upper right door 31 may be a force of a user to push the upper right door 31 or an inertial force according thereto while the upper right door 31 is closed and may be a magnetic force that acts between a magnet (not shown) provided in the upper right door 31 and the body 10 after the upper right door 31 is closed. That is, the magnet that generates a magnetic force to fasten the upper right door 31 after the upper right door 31 is closed may be provided in the upper right door 31. The magnet may be provided in a gasket provided on a rear side of the upper right door 31.

However, the damping device 50 is merely an example. That is, a structure including the cylinder 51 and the piston 60 that moves back and forth will suffice to be the damping device 50 to which the concept of the present disclosure is applied, regardless of whether a member that generates a damping force is a fluid or a spring, while there is no limitation in detailed structure for generating the damping force.

The pressurizing rod 61 includes a head portion 62 (refer to FIG. 3) directly pressurized by the upper right door 31 when the upper right door 31 is closed. The pressurizing rod 61 includes a pressurized surface 63 to be pressurized by the pressurizing roller portion 36 (refer to FIG. 8) provided on the upper right door 31.

The pressurizing roller portion 36 may include a base portion 37 coupled to a top side 31*a* of the upper right door 31, a roller installation portion 38 that extends from the base portion 37, and a roller 39 installed in the roller installation portion 38.

The roller 39 may be formed of rubber to have an elastic force. The roller 39 may be rotatably provided at an end of the roller installation portion 38. Accordingly, when pressurizing the pressurizing rod 61, the roller 39 may be in contact with the pressurized surface 63 and may softly pressurize the pressurized surface 63 while slightly sliding on the pressurized surface 63.

The head portion 62 may pass through a guide path 98 of the guide rail 90 described above. Accordingly, the head portion 62 may have a size smaller than or at least identical to the guide path 98. The head portion 62 may be guided by a pair of guide walls 94 and 96 of the guide rail 90 described above.

The head portion 62 may include separation prevention protrusions 64 to be inserted into separation prevention grooves 95 and 97 not to be separated from the guide rail 90.

The damper housing 65 protects the damping device 50 and couples the damping device 50 to the hinge cover 100.

The damper housing 65 includes a damper accommodating portion 66 that accommodates the damping device 50. The damper accommodating portion 66 is provided with an open top side in such a way that the damping device 50 may be inserted into the damper accommodating portion 66 through the open top side.

The damper housing 65 includes a first coupling portion 67 (refer to FIG. 5) that protrudes to be coupled to the hinge cover 100. Corresponding thereto, the hinge cover 100 may include a second coupling portion 105 (refer to FIG. 5) to be coupled to the first coupling portion 67.

The first coupling portion 67 may be an insertion-protrusion, and the second coupling portion 105 may include an insertion groove 106 into which the first coupling portion 67 is inserted. The first coupling portion 67 may slide in one direction to be inserted into the insertion groove 106. For example, the first coupling portion 67 may slide in a direction from the front toward the rear to be inserted into the insertion groove 106.

The first coupling portion 67 may include a fixing protrusion 68 for fixing the damper 40. Corresponding thereto, the second coupling portion 105 may include a fixing groove 107 to which the fixing protrusion 68 is fixed. The fixing protrusion 68 may be inserted into the fixing groove 107 while the first coupling portion 67 slides and is inserted into the insertion groove 106, thereby fixing the damper 40 to the hinge cover 100.

However, such a coupling structure is merely an example and the damper 40 suffices to be coupled to the hinge cover 100. For example, the damper 40 and the hinge cover 100 may be coupled through an additional fastening member in addition to such a fitting structure.

The term hinge has a meaning identical to a hinge.

The hinge 70 connects the body 10 to the upper right door 31. The hinge 70 is coupled to the upper wall 11 of the body 10. The hinge 70 may include the hinge bracket 80 coupled to the body 10, the guide rail 90 that guides the movement of the damper 40, and a pivot shaft 86 that rotatably supports the upper right door 31.

Referring to FIG. 7, the hinge 70 will be described.

The hinge bracket 80 may be an integral plate having rigidity. The hinge bracket 80 includes a main supporting portion 81 coupled to the upper wall 11 of the body 10 and an extension portion 83 that extends forward from the main supporting portion 81 toward a top of the upper right door 31.

The main supporting portion 81 and the extension portion 83 may be integrally formed. The main supporting portion 81 and the extension portion 83 may have a certain step. The main supporting portion 81 and the extension portion 83 may be horizontally provided. A pivot shaft insertion groove 85 into which the pivot shaft 86 is inserted may be formed on the extension portion 83.

The pivot shaft 86 may sequentially be inserted into the pivot shaft insertion groove 85 of the hinge 70 and a pivot shaft insertion groove 35 of the upper right door 31 and may rotatably support the upper right door 31. The pivot shaft 86 has a hollow 87 through which a wire W (refer to FIGS. 9 and 10) passes. Accordingly, the wire W that extends from an inside of the upper right door 31 to the outside may pass through the hollow 87 of the pivot shaft 86 and may be connected to an inside of the body 10 through a connection opening 11*b* of the upper wall 11 of the body 10.

The main supporting portion 81 may be strongly coupled to the upper wall 11 of the body 10 using an additional fastening member. For this, the main supporting portion 81 may include a fastening hole 82 to which the fastening member is fastened.

The guide rail 90 may perform a guide function of guiding the damper 40 to smoothly operate and a protection function of protecting the wire W that connects the inside of the upper right door 31 to the inside of the body 10 from being affected by the operation of the damper 40.

The guide rail 90 may be coupled to the extension portion 83 of the hinge bracket 80. The guide rail 90 may be strongly coupled to the extension portion 83 of the hinge bracket 80 using an additional fastening member S. The fastening member S includes various mechanically fastening elements capable of coupling a plurality of members, such as a screw, bolt, pin, rivet, etc.

For this, the guide rail 90 may include a fastening hole 92 to which the fastening member S is fastened.

However, unlike the embodiment, the hinge bracket 80 and the guide rail 90 may be integrally formed. That is, the hinge bracket 80 and the guide rail 90 may be integrally formed through die casting.

The guide rail 90 may include a rail body 91 to be coupled to the hinge bracket 80 and a guide portion 93 that guides a movement of the pressurizing rod 61 of the damper 40.

The rail body 91 may be provided in a plate shape and may be in close contact with the hinge bracket 80. The rail body 91 may be formed with the fastening hole 92 described above.

The guide portion 93 may be formed above the rail body 91. The rail body 91 and the guide portion 93 may be integrally formed.

The guide portion 93 may include the pair of guide walls 94 and 96 provided on both sides of the pressurizing rod 61 to extend along a movement direction of the pressurizing rod 61 to guide to the movement of the pressurizing rod 61. Between the pair of guide walls 94 and 96, the guide path 98 through which the pressurizing rod 61 passes may be formed.

The separation prevention grooves 95 and 97 may be formed on the pair of guide walls 94 and 96, respectively, to prevent a separation of the pressurizing rod 61.

The hinge cover 100 is coupled to the upper wall 11 of the body 10 to protect and cover the hinge 70 and the damper 40. The hinge cover 100 may have an approximate box shape with an open bottom.

That is, the hinge cover 100 includes an upper wall 101 and a sidewall portion 102 that extends downward from an edge of the upper wall 101. In the embodiment, the upper wall 101 has a shape with both left and right sides that further protrude forward but is not limited thereto. Also, the term the sidewall portion 102 includes all portions that extend downward from the edge of the upper wall 101 regardless of front, rear, left, and right.

A hinge accommodating portion 103 that accommodates the hinge 70 therein is formed inside the upper wall 101 and the sidewall portion 102. The hinge accommodating portion 103 may accommodate the damper 40 together. However, since it is necessary for the pressurizing rod 61 of the damper 40 to protrude forward to be in contact with the upper right door 31, an opening 104 through which the pressurizing rod 61 of the damper 40 passes may be formed in the sidewall portion 102 of the hinge accommodating portion 103.

As described above, in accordance with the embodiment of the present disclosure, the damper 40 may be coupled to the hinge cover 100, thereby easily installing the damper 40. It is possible to install the damper 40 in a refrigerator cylinder does not have the damper 40 merely by forming a coupling portion for coupling the damper 40 in the hinge cover 100 of the refrigerator.

As is apparent from the above description, an impact that occurs when a door is closed may be mitigated.

Also, a movement of a pressurizing rod of a damper may be smoothly guided, thereby increasing reliability of damping.

Also, a wire cylinder passes through a hinge accommodating portion to connect the door to a body may be safely protected without an effect of the movement of the pressurizing rod of the damper.

Also, the damper cylinder mitigates the impact that occurs when the door is closed may be easily installed.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment formed in the body;

a door that opens or closes the storage compartment;

a damper that mitigates an impact, which occurs when the door is closed, and comprises a cylinder, a piston that moves back and forth in the cylinder, and a pressurizing rod that transfers a pressure applied from the door to the piston; and a hinge that rotatably supports the door and comprises a hinge bracket which connects the body to the door and a guide rail that guides a movement of the pressurizing rod, wherein the guide rail comprises a pair of guide walls that are provided on both sides of the pressurizing rod and extend in a movement direction of the pressurizing rod to guide the movement of the pressurizing rod, and the guide rail comprises separation prevention grooves formed on the pair of guide walls to prevent a separation of the pressurizing rod.

2. The refrigerator of claim 1, wherein the hinge bracket and the guide rail are separately provided and mutually coupled.

3. The refrigerator of claim 1, wherein the guide rail comprises:

a rail body coupled to the hinge bracket; and a guide portion that guides the movement of the pressurizing rod.

4. The refrigerator of claim 1, wherein the guide rail comprises a guide path formed between the pair of guide walls.

5. The refrigerator of claim 1, wherein the pressurizing rod comprises a head portion pressurized by the door and guided by the guide rail.

6. The refrigerator of claim 5, wherein the head portion comprises a separation prevention protrusion that protrudes to prevent a separation from the guide rail.

7. The refrigerator of claim 1, wherein the door comprises a pressurizing roller portion that protrudes to pressurize the pressurizing rod.

8. The refrigerator of claim 7, wherein the pressurizing roller portion comprises:

a base portion coupled to a top side of the door;

a roller installation portion that extends from the base portion; and a roller rotatably installed in the roller installation portion.

9. A refrigerator comprising:

a body;

a storage compartment formed in the body;

a door that opens or closes the storage compartment;

a hinge that rotatably supports the door;

a hinge cover coupled to a top of the body to cover the hinge; and a damper that mitigates an impact, which occurs when the door is closed, and is coupled to the hinge cover, wherein the hinge cover comprises:

an upper wall;

a sidewall portion that extends downward from an edge of the upper wall; and a hinge accommodating portion formed inside the upper wall and the sidewall portion, and wherein the damper is coupled to an inside surface of the upper wall.

10. The refrigerator of claim 9, wherein the damper comprises:

a damping device that performs a damping operation; and a damper housing that accommodates the damping device and coupled to the hinge cover.

11. The refrigerator of claim 10, wherein the damper housing comprises a first coupling portion that protrudes to be coupled to the hinge cover.

12. The refrigerator of claim 11, wherein the hinge cover comprises a second coupling portion coupled to the first coupling portion.

13. The refrigerator of claim 9, wherein the hinge cover comprises an opening through which the damper passes.

14. A refrigerator comprising:

a body;

a storage compartment formed in the body;

a door that opens or closes the storage compartment;

a hinge that rotatably supports the door;

a damper that mitigates an impact, which occurs when the door is closed; and a hinge cover coupled to a top of the door to form a hinge accommodating portion that accommodates the hinge and the damper, wherein the hinge cover comprises:

an upper wall; and a sidewall portion that extends downward from an edge of the upper wall, and wherein the damper is coupled to the upper wall.

15. The refrigerator of claim 14, wherein the damper comprises:

a moving part having a movement according to an opening and closing operation of the door; and a cylinder part fixed to the hinge cover regardless of the opening and closing operation of the door, and wherein the hinge comprises a guide rail that guides the movement of the moving part.

* * * * *